US008019265B2

(12) United States Patent
Barton et al.

(10) Patent No.: US 8,019,265 B2
(45) Date of Patent: Sep. 13, 2011

(54) METHOD AND APPARATUS FOR STRIPPING MEDIA FROM A SURFACE IN AN APPARATUS USEFUL IN PRINTING

(75) Inventors: Augusto E. Barton, Webster, NY (US); Anthony S. Condello, Webster, NY (US); Bin Zhang, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/634,024

(22) Filed: Dec. 9, 2009

(65) Prior Publication Data

US 2011/0135350 A1 Jun. 9, 2011

(51) Int. Cl.
*G03G 15/20* (2006.01)

(52) U.S. Cl. ..... 399/323; 399/329

(58) Field of Classification Search ..... 399/323, 399/329

See application file for complete search history.

(56) References Cited

U.S. PATENT DOCUMENTS

| | | | | |
|---|---|---|---|---|
| 5,157,446 | A * | 10/1992 | Kusaka | 399/329 |
| 2004/0052555 | A1* | 3/2004 | Berkes et al. | 399/329 |
| 2004/0120735 | A1* | 6/2004 | Baba et al. | 399/323 |
| 2006/0210331 | A1 | 9/2006 | Baba et al. | |
| 2007/0048035 | A1 | 3/2007 | Baba et al. | |
| 2007/0048042 | A1 | 3/2007 | Uehara et al. | |
| 2007/0092277 | A1 | 4/2007 | Miyata et al. | |
| 2007/0166084 | A1 | 7/2007 | Yoshino et al. | |
| 2007/0172272 | A1 | 7/2007 | Miyata et al. | |
| 2008/0037069 | A1 | 2/2008 | Mestha et al. | |
| 2009/0116885 | A1* | 5/2009 | Ando | 399/329 |

OTHER PUBLICATIONS

Augusto E. Barton; U.S. Appl. No. 12/512,272, filed Jul. 30, 2009.
Christine A. Keenan et al.; U.S. Appl. No. 12/352,250, filed Jan. 12, 2009.
William A. Burton et al.; U.S. Appl. No. 12/363,724, filed Jan. 31, 2009.
Anthony S. Condello et al.; U.S. Appl. No. 12/490,601, filed Jun. 24, 2009.
Augusto E. Barton et al.; U.S. Appl. No. 12/575,135; filed Oct. 7, 2009.

* cited by examiner

*Primary Examiner* — David Gray
*Assistant Examiner* — Laura Roth
(74) *Attorney, Agent, or Firm* — Ronald E. Prass, Jr.; Prass LLP

(57) ABSTRACT

An apparatus and method for stripping media from a surface and useful in printing may include a first member, a fixing belt, a first nip, a second nip, and a stripping device including a curved stripping edge contacting the inner surface of the fixing belt, the stripping edge being defined by a radius of less than about 10 mm, the stripping edge being spaced from the first outlet end of the first nip by a distance of less than about 10 mm, and the fixing belt bending at a stripping angle of about 20° to about 30° at the stripping edge, the stripping device being adjustably movable by a mechanism to vary the distance from the stripping edge to the first outlet end of the first nip, wherein media are stripped from an outer surface of the fixing belt after exiting from the first outlet end of the first nip.

17 Claims, 8 Drawing Sheets

METHOD AND APPARATUS FOR STRIPPING MEDIA FROM A SURFACE IN AN APPARATUS USEFUL IN PRINTING

BACKGROUND

Some printing apparatuses include a belt and another member, such as a belt, that form a nip. In such printing apparatuses, media are fed to the nip and contacted with the belt. The media are separated from the belt after passing through the nip.

It would be desirable to provide apparatuses useful in printing and associated methods that can be used to separate different types of media from belts more effectively.

SUMMARY

Apparatuses useful in printing and methods for stripping media from surfaces in apparatuses useful in printing are disclosed. An exemplary embodiment of the apparatuses useful in printing comprises a first member including a first outer surface; a second member including a second outer surface; a fixing belt including an inner surface and a third outer surface; a first nip formed by contact between the inner surface of the fixing belt and the second outer surface and contact between the third outer surface of the fixing belt and the first outer surface, the first nip including a first inlet end and a first outlet end at which the fixing belt separates from the second outer surface; a second nip formed by contact between the third outer surface of the fixing belt and the first outer surface, the second nip extending from the first outlet end to a second outlet end at which the fixing belt separates from the first outer surface, the second nip having a length of less than about 8 mm between the first outlet end and the second outlet end; and a stripping device including a curved stripping edge contacting the inner surface of the fixing belt. The stripping edge is defined by a radius of less than about 10 mm, the stripping edge is spaced from the first outlet end of the first nip by a distance of less than about 10 mm, and the fixing belt bends at a stripping angle of about 20° to at least about 30° at the stripping edge. Media are stripped from the third outer surface after exiting from the first outlet end of the first nip.

DRAWINGS

Figure 7:
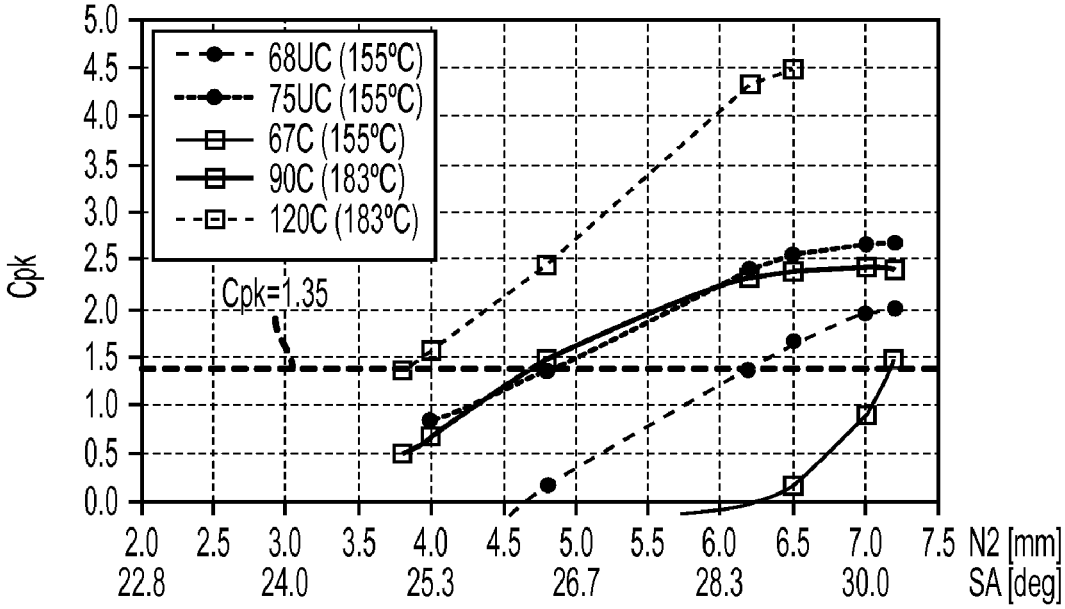

FIG. 7 illustrates shows the process capability index $C_{pk}$ as a function of second nip $N_2$ length and stripping angle ($\alpha$) for 68 gsm uncoated paper (68UC), 75 gsm uncoated paper (75UC), 67 gsm coated paper (67C), 90 gsm coated paper (90C) and 120 gsm coated paper (120C) for a stripping radius R of 1 mm without an air knife and a lead edge bleed of $\geqq 3$ mm.

Figure 8:
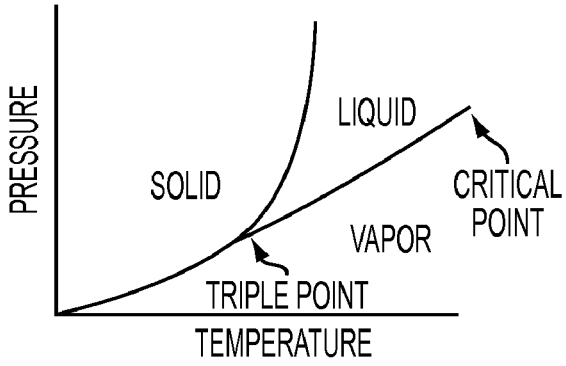

FIG. 8 illustrates a phase diagram of water.

Figure 9:
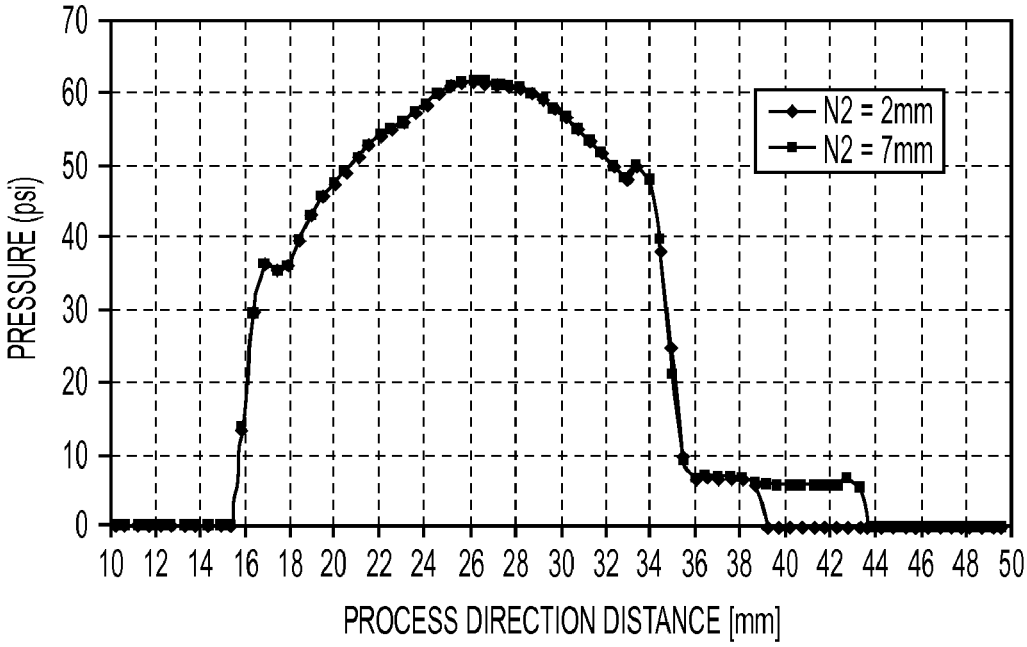

FIG. 9 illustrates the nip pressure as a function of the process direction distance for second nip $N_2$ lengths of 2 mm and 7 mm.

Figure 10:
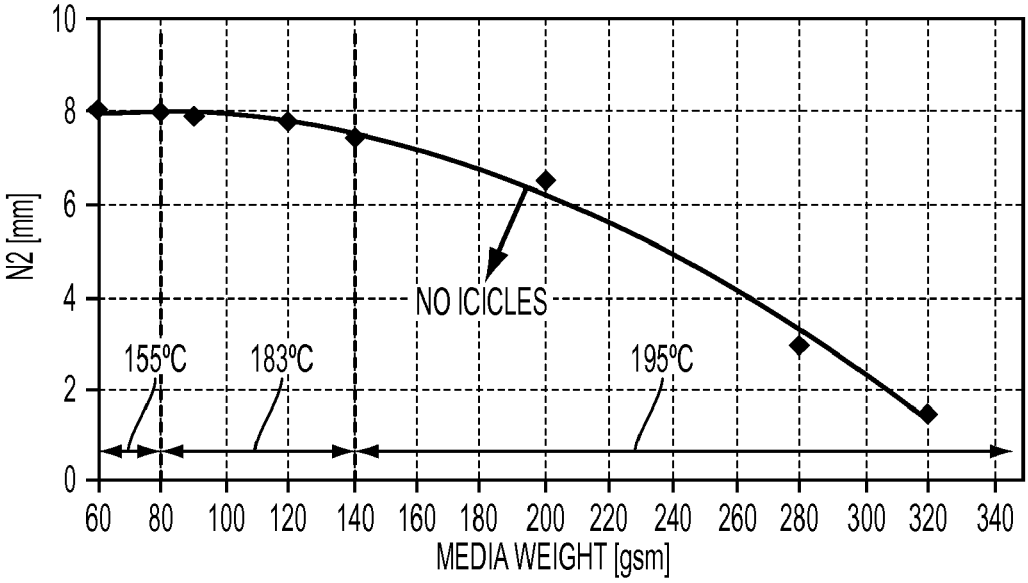

FIG. 10 illustrates the length of the second nip $N_2$ as a function of the media weight to avoid icicle defect formation.

Figure 11:
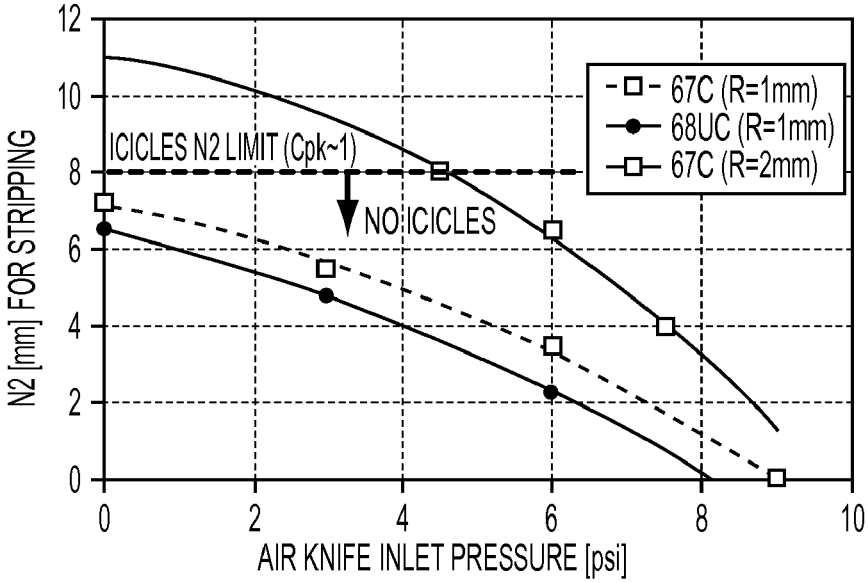

FIG. 11 illustrates the second nip $N_2$ length as a function of air knife inlet pressure for a fixing device including a stripping device and an air knife for 67 gsm coated paper (67C) at a stripping radius of 1 mm, 68 gsm uncoated paper (68UC) at a stripping radius of 1 mm, and 67 gsm coated paper (67C) at a stripping radius of 2 mm.

DETAILED DESCRIPTION

The disclosed embodiments include apparatuses useful in printing. An exemplary embodiment of the apparatuses comprises a first member including a first outer surface; a second member including a second outer surface; a fixing belt including an inner surface and a third outer surface; a first nip formed by contact between the inner surface of the fixing belt and the second outer surface and contact between the third outer surface of the fixing belt and the first outer surface, the first nip including a first inlet end and a first outlet end at which the fixing belt separates from the second outer surface; a second nip formed by contact between the third outer surface of the fixing belt and the first outer surface, the second nip extending from the first outlet end to a second outlet end at which the fixing belt separates from the first outer surface, the second nip having a length of less than about 8 mm between the first outlet end and the second outlet end; and a stripping device including a curved stripping edge contacting the inner surface of the fixing belt. The stripping edge is defined by a radius of less than about 10 mm, the stripping edge is spaced from the first outlet end of the first nip by a distance of less than about 10 mm, and the fixing belt bends at a stripping angle of about 20° to at least about 30° at the stripping edge. Media are stripped from the third outer surface after exiting from the first outlet end of the first nip.

Another exemplary embodiment of the apparatuses useful in printing comprises a first roll including a first outer surface; a second roll including a second outer surface; a heated fixing belt including an inner surface and a third outer surface; a first nip formed by contact between the inner surface of the fixing belt and the second outer surface and contact between the third outer surface of the fixing belt and the first outer surface, the first nip including a first inlet end and a first outlet end at which the fixing belt separates from the second outer surface; a second nip formed by contact between the third outer surface of the fixing belt and the first outer surface, the second nip extending from the first outlet end to a second outlet end at which the fixing belt separates from the first outer surface, the second nip having a length of less than about 8 mm between the first outlet end and the second outlet end; and a stripping device including a curved stripping edge contacting the inner surface of the fixing belt. The stripping edge is defined by a radius of less than about 10 mm, the stripping edge is spaced from the first outlet end of the first nip by a distance of less than about 8 mm, and the fixing belt bends at a stripping angle of about 20° to at least about 30° at the stripping edge. Media are stripped from the third outer surface after exiting from the first outlet end of the first nip.

The disclosed embodiments further include methods of stripping media from surfaces in apparatuses useful in printing. In an exemplary embodiment of the methods, the apparatus comprises a first roll including a first outer surface, a second roll including a second outer surface, a heated fixing belt including an inner surface and a third outer surface, a first nip formed by contact between the inner surface of the fixing belt and the second outer surface and contact between the third outer surface of the fixing belt and the first outer surface, the first nip including a first inlet end and a first outlet end at which the fixing belt separates from the second outer surface, a second nip formed by contact between the third outer surface of the fixing belt and the first outer surface, the second nip extending from the first inlet end to a second outlet end at which the fixing belt separates from the first outer surface, and a stripping device disposed internal to the fixing belt, the stripping device including a curved stripping edge contacting the inner surface of the fixing belt, the stripping edge being defined by a radius of less than about 10 mm. The method comprises positioning the stripping device to set a length of the second nip between the first outlet end and the second outlet end to less than about 8 mm and a distance from the stripping edge to the first outlet end to less than about 8 mm, the fixing belt bending at a stripping angle of about 20° to at least about 30° at the stripping edge; contacting a medium carrying a marking material with the third outer surface of the belt at the first nip; and stripping the medium from the third outer surface of the belt downstream from the first nip with the stripping device.

As used herein, the term "printing apparatus" encompasses any apparatus that performs a print outputting function for any purpose. Such apparatuses can include, e.g., printers, copiers, facsimile machines, bookmaking machines, multi-function machines, and the like.

Figure 1:
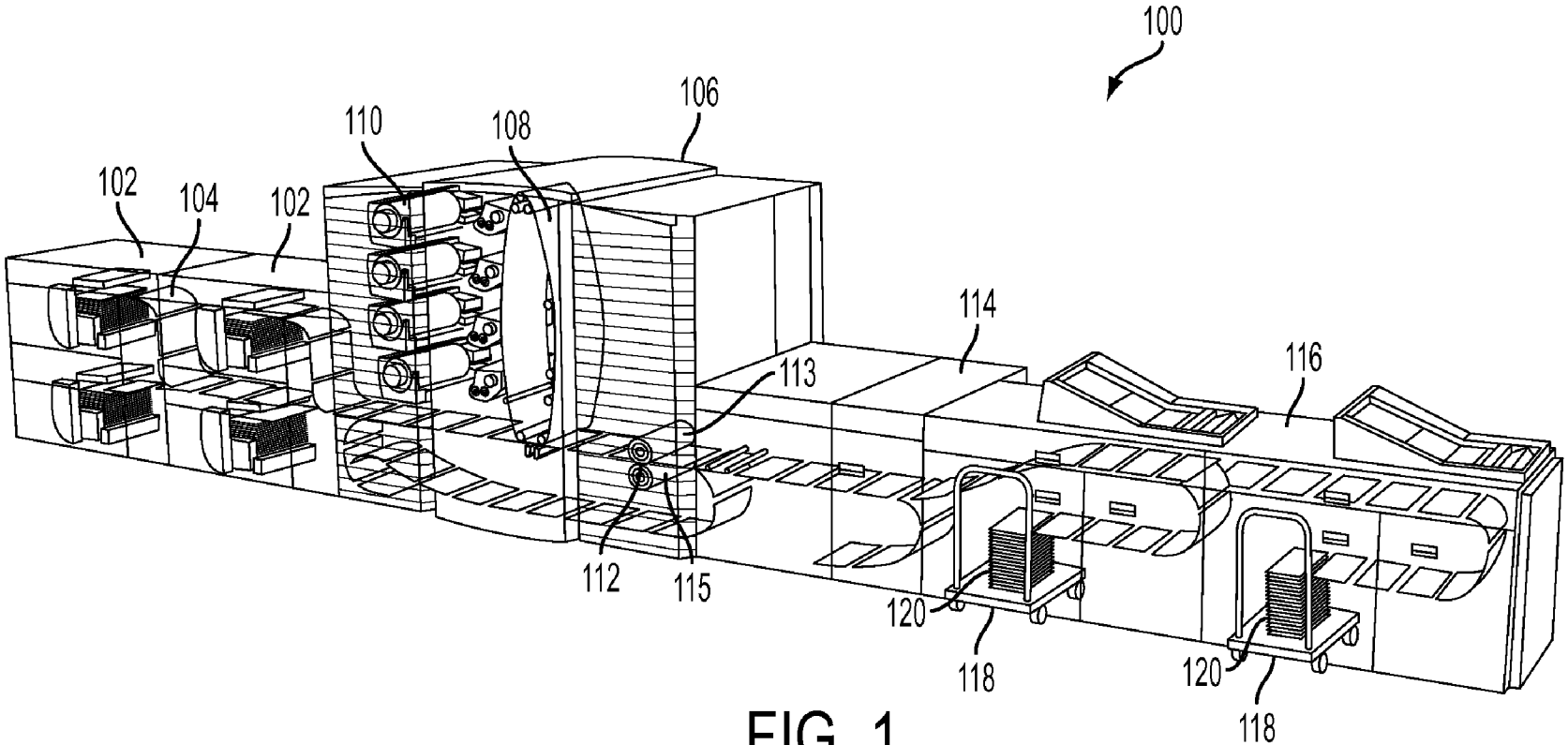
FIG. 1 depicts an exemplary embodiment of a printing apparatus.

FIG. 1 illustrates an exemplary printing apparatus 100, as disclosed in U.S. Patent Application Publication No. 2008/0037069, which is incorporated herein by reference in its entirety. The printing apparatus 100 can be used to produce prints from various types of media of different sizes and weights. The printing apparatus 100 includes two media feeder modules 102 arranged in series, a printer module 106 adjacent the media feeder modules 102, an inverter module 114 adjacent the printer module 106, and two stacker modules 116 arranged in series adjacent the inverter module 114.

In the printer module 106, marking material (toner) is transferred from a series of developer stations 110 to a charged photoreceptor belt 108 to form toner images on the photoreceptor belt and produce color prints. The toner images are transferred to one side of media 104 fed through the paper path. The media are advanced through a fixing device 112 including a fixing roll 113 and pressure roll 115. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

The fixing roll 113 and the pressure roll 115 together forms a nip. At the nip, heat and pressure are applied to media on which marking material has been applied to fix the marking material. The fixing roll 113 can include an outer layer made of an elastomeric material having an outer region that experiences strain, or "creep," when the fuser roll 113 and pressure roll 115 are engaged with each other. In the fixing device 112, creep of the outer region of the fixing roll 113 is used to strip media from this roll after the media pass through the nip. In such fixing devices, high creep is typically used to strip less-rigid, light-weight media, while lower creep is used to strip more-rigid, heavy-weight media.

In such fixing devices, to achieve high process speeds and high ppm values, higher power requirements are required. For such higher power requirements to be achieved, bigger fixing rolls are required. However, bigger fixing rolls have stripping limitations due to having lower creep.

In light of these and other considerations, apparatuses useful in printing and methods of stripping media from surfaces in apparatuses useful in printing are provided. Embodiments of the apparatuses include a heated fixing belt. In embodiments, the belt and another member, e.g., an external pressure roll or a second belt, form a nip. At the nip, the fixing belt and other member apply heat and/or pressure to fix marking material onto media. The media are then stripped (mechanically separated) from the outer surface of the fixing belt using a stripping device that causes the fixing belt to bend and form a sufficiently-small radius to force the media to strip from the fixing belt.

Figure 2:
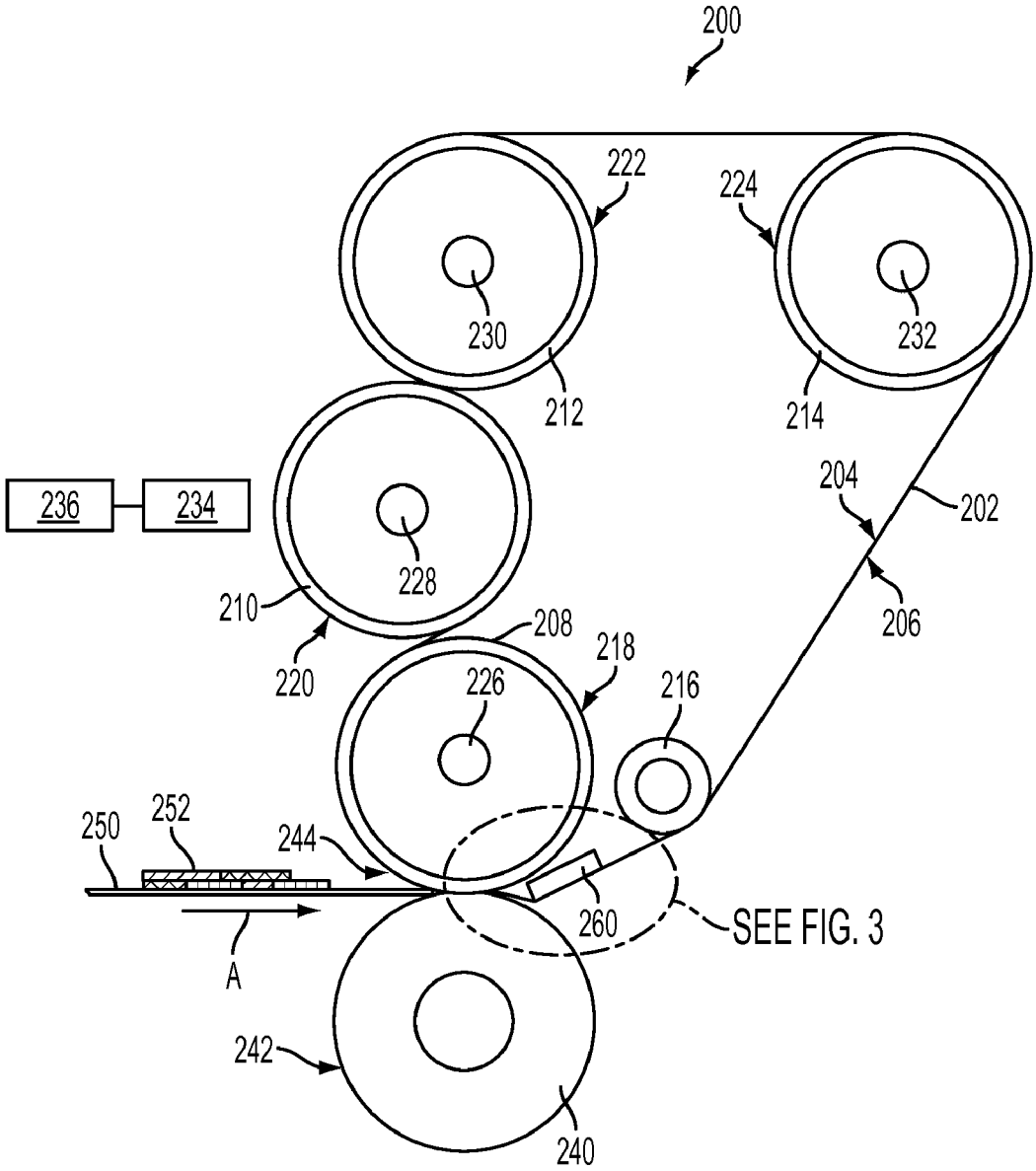
FIG. 2 depicts an exemplary embodiment of an apparatus useful in printing including a media stripping device.

FIG. 2 illustrates an exemplary embodiment of an apparatus useful in printing including a fixing device 200. Embodiments of the fixing device 200 can be used in various printing apparatuses. For example, the fixing device 200 can be used in the printing apparatus 100 shown in FIG. 1, in place of the fixing device 112.

As shown in FIG. 2, the fixing device 200 includes an endless (continuous) belt 202 supported by a fixing roll 208, an external roll 210 and internal rolls 212, 214 and 216. Other embodiments of the fixing device 200 can have different architectures, such as a different number of rolls supporting the belt 202.

The belt 202 includes an inner surface 204 and an outer surface 206. The fixing roll 208, external roll 210 and internal rolls 212, 214 include respective outer surfaces 218, 222 and 224 contacting the belt 202. In the illustrated embodiment, the fixing roll 208, external roll 210 and internal rolls 212, 214 are internally heated by heating elements 226, 228, 230 and 232, respectively. The heating elements 226, 228, 230 and 232 can include one or more axially-extending lamps. The heating elements are electrically connected to a power supply 234. The power supply 234 is electrically connected to a controller 236 configured to control the supply of power to the heating elements 226, 228, 230 and 232 to control heating of the belt 202.

The fixing device 200 further includes an external pressure roll 240 including an outer surface 242. In embodiments, the outer surface 242 can be comprised of an elastically deformable material, such as silicone rubber, perfluoroalkoxy (PFA) copolymer resin, or the like.

Embodiments of the belt 202 can have a multi-layer construction including, e.g., a base layer, an intermediate layer on the base layer, and an outer layer on the intermediate layer. In such embodiments, the base layer forms the inner surface 204, and the outer layer forms the outer surface 206 of the belt 202. In an exemplary embodiment of the belt 202, the base layer is composed of a polymeric material, such as polyimide, or the like; the intermediate layer is composed of silicone, or the like; and the outer layer is composed of a polymeric material, such as a fluoroelastomer sold under the trademark Viton® by DuPont Performance Elastomers, L.L.C., polytetrafluoroethylene (Teflon®), or the like.

In embodiments, the belt 202 may have a thickness of about 0.1 mm to about 0.6 mm, and be referred to as a "thin belt." The belt 202 can typically have a width of about 350 mm to about 450 mm, and a length of about 500 mm to at least about 1000 mm.

FIG. 2 depicts a medium 250 being fed to a nip 244 formed by the belt 202 and the pressure roll 240 in the process direction A. The medium 250 includes marking material 252 (e.g., toner). The marking material 252 contacts the outer surface 206 of the belt 202 at the nip 244. In embodiments, the fixing roll 208 is rotated counter-clockwise, and the pressure roll 240 is rotated clockwise, to convey the medium 250 through the nip 244 in the process direction A and rotate the belt 202 counter-clockwise.

The medium 250 can be a sheet of paper, a transparency or packaging material, for example. Paper is typically classified by weight, as follows: lightweight: ≦ about 75 gsm, midweight: about 75 gsm to about 160 gsm, and heavyweight: ≧160 gsm.

As shown in FIG. 2, the fixing device 200 further includes a stripping device 260 for stripping media from the outer surface 206 of the belt 202 after the media exit from the nip 244 traveling in the process direction A.

Figure 3:
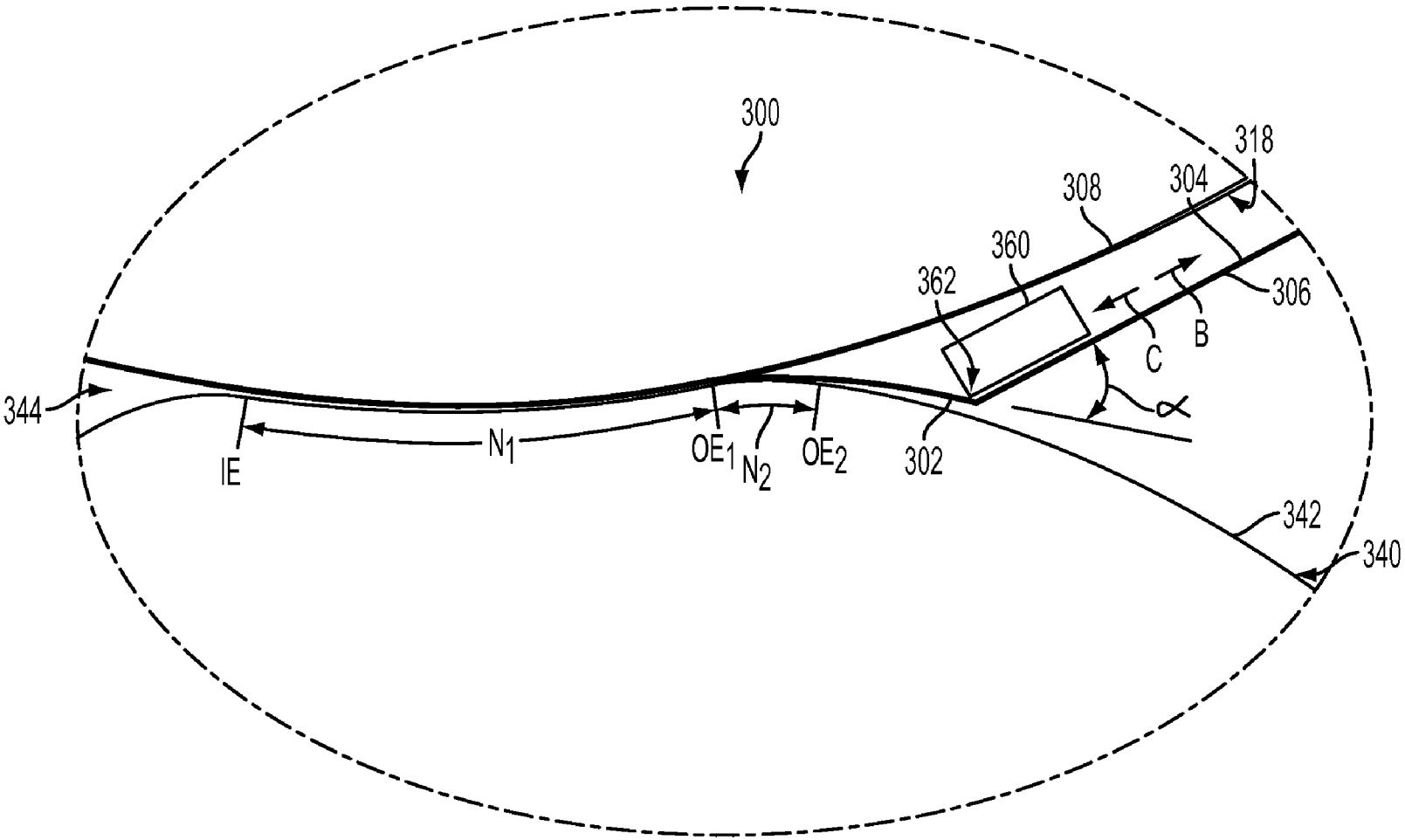
FIG. 3 depicts an enlarged partial view of a portion of an apparatus as shown in FIG. 2.

FIG. 3 depicts an enlarged view of a portion of a fixing device 300 according to an exemplary embodiment. The fixing device 300 can have the same configuration as the fixing device 200 depicted in FIG. 2, for example. The fixing device 300 includes a fixing roll 308, pressure roll 340, fixing belt 302 extending between the outer surface 318 of the fixing roll 308 and the outer surface 342 of the pressure roll 340, and a stripping device 360. The stripping device 360 is located between the fixing belt 302 and the fixing roll 308.

A nip 344 is formed by the outer surface 306 of the fixing belt 302 and the outer surface 342 of the pressure roll 340. The nip 344 includes both a first nip, $N_1$, and a second nip, $N_2$. The first nip $N_1$ extends in the process direction between an inlet end, IE, where media enter the first nip $N_1$, and an outlet end $OE_1$, where the media exit from the first nip $N_1$. The first nip $N_1$ can typically have a length of about 15 mm to about 22 mm when the fixing roll 308 has a diameter of about 75 mm to about 100 mm. At the first nip $N_1$, the fixing belt 302 contacts the outer surface 318 of the fixing roll 308 and the outer surface 342 of the pressure roll 340. The fixing belt 302 and pressure roll 340 apply sufficient thermal energy and pressure to media fed to the first nip $N_1$ to fix marking material onto the media. The pressure at the first nip $N_1$ can typically be about 45 psi to about 120 psi.

As shown in FIG. 3, the fixing belt 302 separates from the outer surface 318 of the fixing roll 308 at the outlet end $OE_1$ of the first nip $N_1$. The outer surface 306 of the fixing belt 302 and the outer surface 342 of the pressure roll 340 together form the second nip $N_2$ adjacent to the outlet end $OE_1$ of the first nip $N_1$. The second nip $N_2$ extends from the outlet end $OE_1$ to an outlet end $OE_2$. The second nip $N_2$ can typically have a length of about 2 mm to about 7 mm from $OE_1$ to $OE_2$ (when the second nip $N_2$ maximum length is about 8 mm) when the fixing roll 308 has a diameter of about 100 mm. In embodiments, the maximum length of the second nip $N_2$ is controlled by the distance between the outlet end $OE_1$ of the first nip $N_1$ and a curved stripping edge of the stripping device 360. In embodiments, this distance is set as small as possible (e.g., about 8 mm or less), with the fixing belt 302 extending at a stripping angle of at least about 20°. The length of the second nip $N_2$ can be determined based on the weight (e.g., thickness) of media used in the fixing device 300.

The second nip $N_2$ facilitates stripping of media from the outer surface 306 of the fixing belt 302. At the second nip $N_2$, the outer surface 306 of the fixing belt 302 applies low pressure to the outer surface 342 of the pressure roll 340. The pressure at the second nip $N_2$ is lower than the pressure at the first nip $N_1$, and can typically be about 6 psi to about 15 psi.

The stripping device 360 contacts the inner surface 304 of the fixing belt 302. As shown, the stripping device 360 includes a stripping edge 362. At the stripping edge 362, the belt 302 bends at a stripping angle, $\alpha$. It has been determined that the stripping force produced by the stripping device 360 increases as the stripping angle $\alpha$ is increased in the range from 0° to about 20°. It has further been determined that when the stripping angle $\alpha$ is less than about 20°, the stripping force produced by the stripping device 360 may not be sufficient to strip media from the fixing belt 302, as the maximum stripping force typically occurs at a stripping angle $\alpha$ of about 15° to about 20°. It has been determined that increasing the stripping angle $\alpha$ to more than about 20° does not significantly increase the stripping force produced by the stripping device 360. Based on these findings, it is desirable that the stripping angle $\alpha$ be at least about 20° in the fixing device 300. For example, the stripping angle $\alpha$ can be about 20° to at least about 30° to provide the desired stripping force.

The stripping device 360 can be rotated to adjust the stripping angle $\alpha$. For example, the stripping device 360 can be rotated clockwise to reduce $\alpha$. The stripping angle $\alpha$ can be set at a fixed angle, e.g., about 20°, for stripping all media types in the fixing device 300.

In embodiments, the stripping device 360 is movable toward and away from the pressure roll 340 to adjust the distance (along a straight line) between the stripping edge 362 and the outlet end $OE_1$ of the first nip $N_1$. This distance can typically be about 6 mm to about 10 mm when the fixing roll 308 has a diameter of 100 mm. It is desirable that this distance be less than about 8 mm to prevent image quality defects, such as mottle. The movement of the stripping device 360 can be substantially linear in a direction toward (arrow C) or in a direction away from (arrow B) away from the outlet end $OE_1$. The adjustability of the position of the stripping device 360 allows adjustment of the holding force applied to media by the outer surface 342 of the pressure roll 340 and the outer surface 306 of the fixing belt 302 as the media move through the second nip $N_2$. This holding force can be adjusted based on the type of media used. For example, thicker, heavier media can be stripped from the fixing belt 302 using a lower holding force than is needed for stripping thinner, lighter media.

Exemplary stripping devices that can be used as the stripping device 360 in the fixing device 300 to provide adjustable positioning of the stripping device are described in U.S. patent application Ser. No. 12/363,724, filed on Jan. 31, 2009, which is incorporated herein by reference in its entirety.

Figure 5:
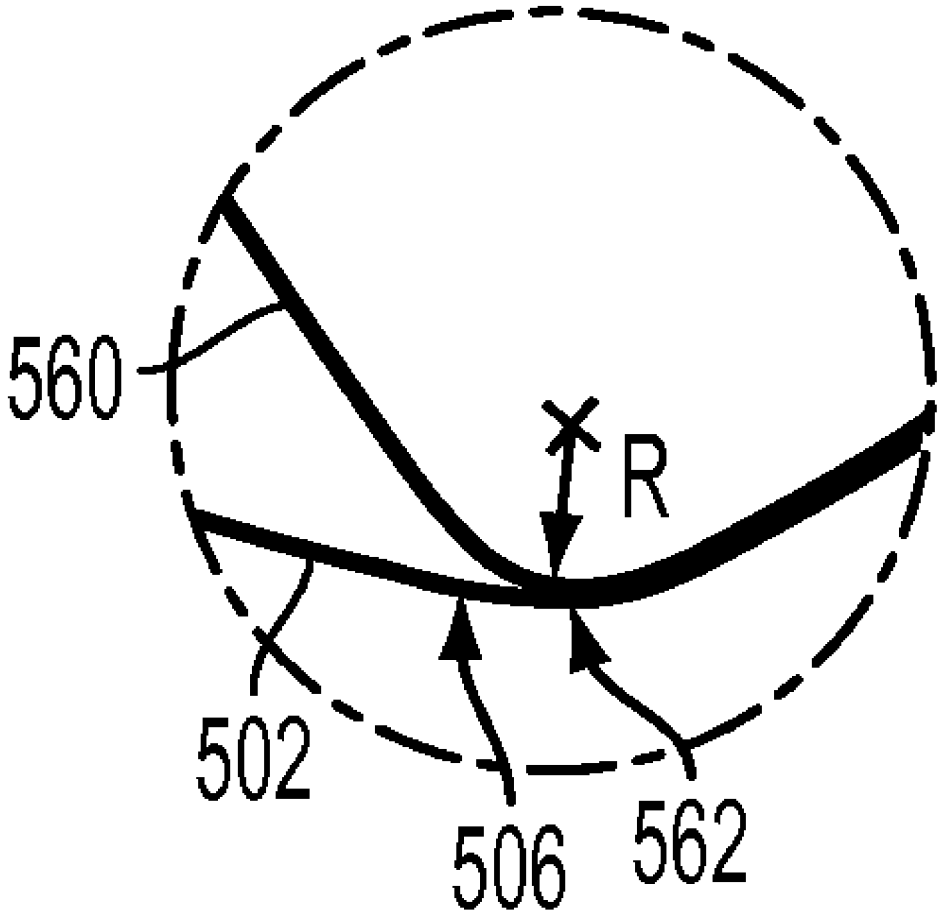
FIG. 5 depicts an enlarged view of a portion of a stripping device as shown in FIG. 4.

FIG. 5 depicts an enlarged view of a portion of a stripping device 560 and a fixing belt 502. The stripping device 560 has the same configuration as the stripping device 360 shown in FIG. 3. As shown, the stripping edge 562 of the stripping device 560 is curved (convex outward). The curvature of the stripping edge 562 is described by a stripping radius, R, which can be about 5 mm or less, such as about 4 mm or less, about 3 mm or less, about 2 mm or less, or about 1 mm or less. It has been determined that a stripping radius R of less than about 5 mm is suitable for different sizes (diameters) of the fixing roll 308 of the fixing device 300, such as a diameter of about 100 mm or greater. The stripping edge 562 creates a small radius on the outer surface of the fixing belt 502 passing over the stripping edge 562. The stripping radius R of the stripping edge 562 can be selected to produce a sufficiently-high stripping force to facilitate stripping of different types of media (carrying marking material) from the outer surface 506 of the fixing belt 502 at the second nip $N_2$. This type of stripping is referred herein to as "geometric stripping."

As the diameter of the fixing roll 308 is increased (e.g., to greater than about 100 mm), the lengths of the first nip $N_1$ and second nip $N_2$, and the distance from the stripping radius R of the stripping device 360 to the outlet end $OE_1$ of the first nip $N_1$ can be increased proportionally, while the stripping radius R can be kept at the same value.

Figure 4:
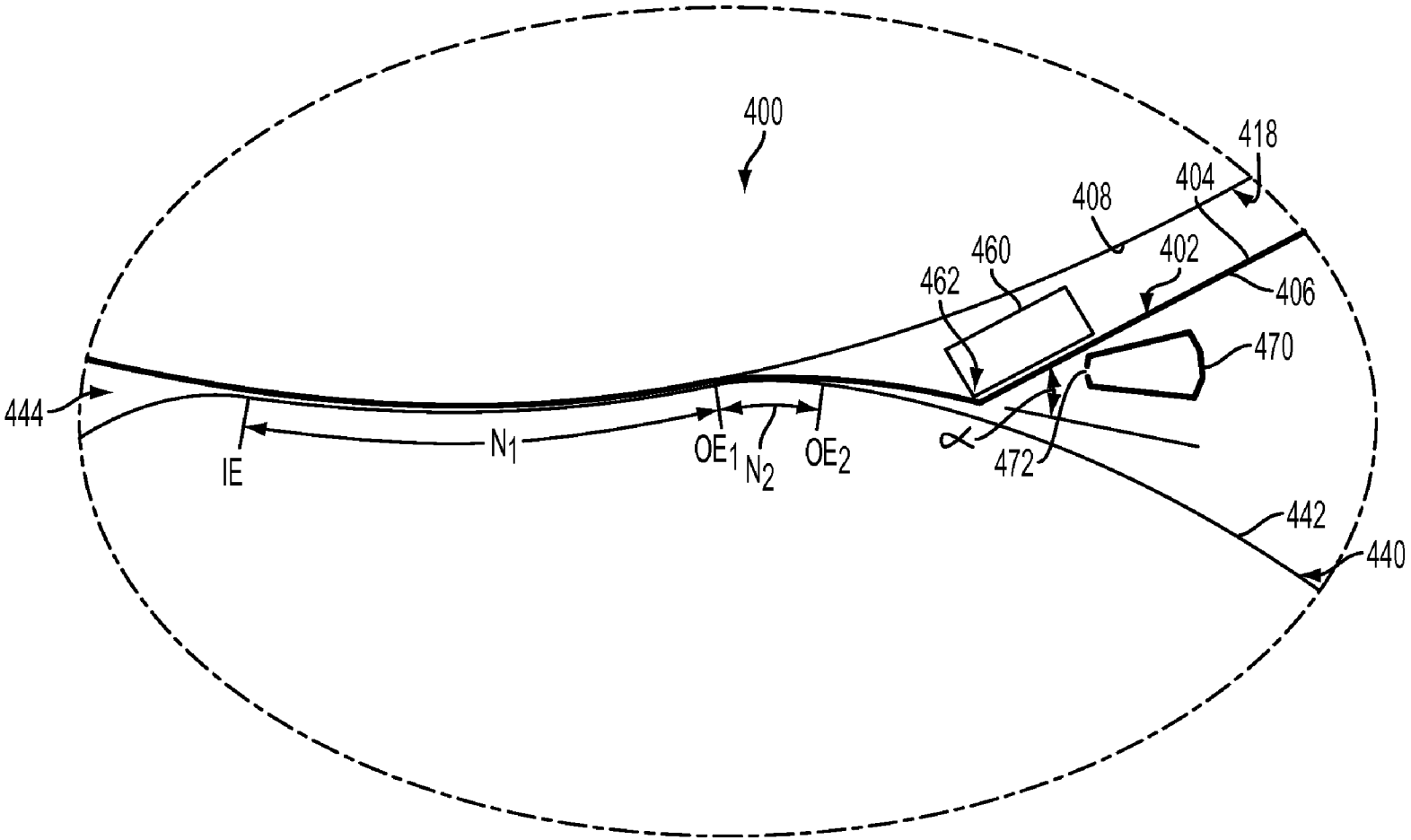
FIG. 4 depicts a portion of another exemplary embodiment of an apparatus useful in printing including a media stripping device and an air knife.

FIG. 4 depicts an enlarged view of a portion of a fixing device 400 according to another exemplary embodiment. The fixing device 400 includes a fixing roll 408, pressure roll 440, fixing belt 402 extending between the outer surface 418 of the fixing roll 408 and the outer surface 442 of the pressure roll 440, and a stripping member 460. The stripping member 460 is disposed between the fixing belt 402 and the fixing roll 408. The components of the fixing device 400 shown in FIG. 4 can have the same configurations as corresponding components in the fixing device 200 depicted in FIG. 2, for example. The fixing device 400 can also include additional components as depicted in FIG. 2.

As shown in FIG. 4, a nip 444 is formed by the outer surface 406 of the fixing belt 402 and the outer surface 442 of the pressure roll 440. The nip 444 includes both a first nip, $N_1$, and a second nip, $N_2$. The first nip $N_1$ extends in the process direction between an inlet end, IE, and an outlet end $OE_1$. The first nip $N_1$ can typically have a length of about 15 mm to about 22 mm when the fixing roll 408 has a diameter of about 75 mm to about 100 mm.

The fixing belt 402 contacts the outer surface 418 of the fixing roll 408 and the outer surface 442 of the pressure roll 440 at the first nip $N_1$. The fixing belt 402 and pressure roll 440 apply thermal energy and pressure to media at the first nip $N_1$ to fix marking material onto the media. The first nip $N_1$ pressure can typically be about 50 psi to about 120 psi.

As shown in FIG. 4, the fixing belt 402 separates from the outer surface 418 of the fixing roll 408 at the outlet end $OE_1$ of the first nip $N_1$. The outer surface 406 of the fixing belt 402 and the outer surface 442 of the pressure roll 440 together form the second nip $N_2$, which is downstream of, and adjacent, to the outlet end $OE_1$ of the first nip $N_1$. The second nip $N_2$ extends from the outlet end $OE_1$ of the first nip $N_1$ to an outlet end $OE_2$.

At the second nip $N_2$, the outer surface 406 of the fixing belt 402 applies pressure to the outer surface 442 of the pressure roll 440. The pressure at the second nip $N_2$ is lower than the pressure at the first nip $N_1$. The second nip $N_2$ pressure can typically be about 6 psi to about 15 psi.

The stripping device 460 contacts the inner surface 404 of the fixing belt 402. The position of the stripping device 460 with respect to the outlet end $OE_1$ of the first nip $N_1$ is fixed. The stripping device 460 includes a stripping edge 462. The stripping edge 462 of the stripping device 460 is curved (convex outward), with the curvature of the stripping edge 462 described by a stripping radius of about 5 mm or less, such as about 4 mm or less, about 3 mm or less, about 2 mm or less, or about 1 mm or less. The distance between the stripping edge 462 and the outlet end $OE_1$ can typically be set at a value of about 6 mm to about 10 mm, and desirably less than about 8 mm, when the fixing roll 408 has a diameter of 100 mm.

The second nip $N_2$ can typically be set to have a length of about 2 mm to about 7 mm from $OE_1$ to $OE_2$ when the fixing roll 408 has a diameter of about 100 mm. The length of the second nip $N_2$ can be determined by the weight (e.g., thickness) of media used in the fixing device 400.

In embodiments, the length of the second nip $N_2$ can be set to a value that provides a sufficiently-high stripping force to media above a selected weight (e.g., heavy-weight media) from the fixing belt 402. When the length of the second nip $N_2$ is set in this manner, the stripping force produced by the stripping device 460 may not be sufficient to strip light-weight media from the stripping belt 402.

The fixing belt 402 bends at an angle, $\alpha$, at the stripping edge 462. The stripping device 460 can be positioned with the stripping edge 462 spaced by a selected distance from the outlet end $OE_1$ of the first nip $N_1$ to provide a sufficiently-high stripping force to strip thicker, heavier media from the fixing belt 402. It is desirable that the stripping angle $\alpha$ be at least about 20° in the fixing device 400. For example, the stripping angle $\alpha$ can be about 20° to at least about 30°.

The fixing device 400 further includes an air knife 470. The air knife 470 can be activated, when desired, to eject gas to provide an additional stripping force for stripping media from the fixing belt 402. The stripping device 460 and air knife 470 can together produce a combined stripping force that is sufficiently-high to strip more difficult media, such as thinner, lighter media, from the outer surface 406 of the fixing belt 402. By being able to apply a portion of the total stripping force with the stripping device 460 and another portion of the total stripping force with the air knife 470, as opposed to applying the entire stripping force with the stripping device 460, the stripping device 460 can be in a fixed position allowing stripping of light-weight media, as well as heavy-weight media, without image quality defects occurring on heavy-weight media.

The air knife 470 shown in FIG. 4 has a generally triangular cross-sectional shape. Other embodiments of the air knife 470 can have other shapes, such as a circular cross-section. The air knife 470 includes nozzles 472 (only one nozzle 470 is shown) disposed along the length dimension of the air knife 470, which is typically approximately parallel to fixing belt 402 with the gas directed close to the stripping edge 462 location. The nozzles 470 eject a gas, such as air, or the like, toward the outer surface 406 of the fixing belt 402. The gas produces a stripping force, which assists in stripping media from the outer surface 406 in the vicinity of the stripping surface 462 of the stripping device 460. Embodiments of the air knife 470 have a small cross-section perpendicular to the length dimension of the air knife 470. The low-profile of the air knife 470 allows it to be positioned close to the outer surface 406 of the fixing belt 402. In addition, the low-profile and positioning capability of the air knife 470 allows different types of media to exit from the second nip $N_2$ and be stripped from the fixing belt 402 without colliding with the air knife 470. Exemplary air knives that provide these features and can be used in the fixing device 400 are described in U.S. patent application Ser. No. 12/575,135, filed on Oct. 7, 2009, which is incorporated herein by reference in its entirety.

As the diameter of the fixing roll 408 is increased (e.g., to above 100 mm), the lengths of the first nip $N_1$ and the second nip $N_2$, and the distance from the stripping edge 462 of the stripping device 460 to the outlet end $OE_1$ of the first nip $N_1$ can be increased proportionally, in the case that productivity is increased, while the stripping radius R can be kept at the same value.

Figure 6:
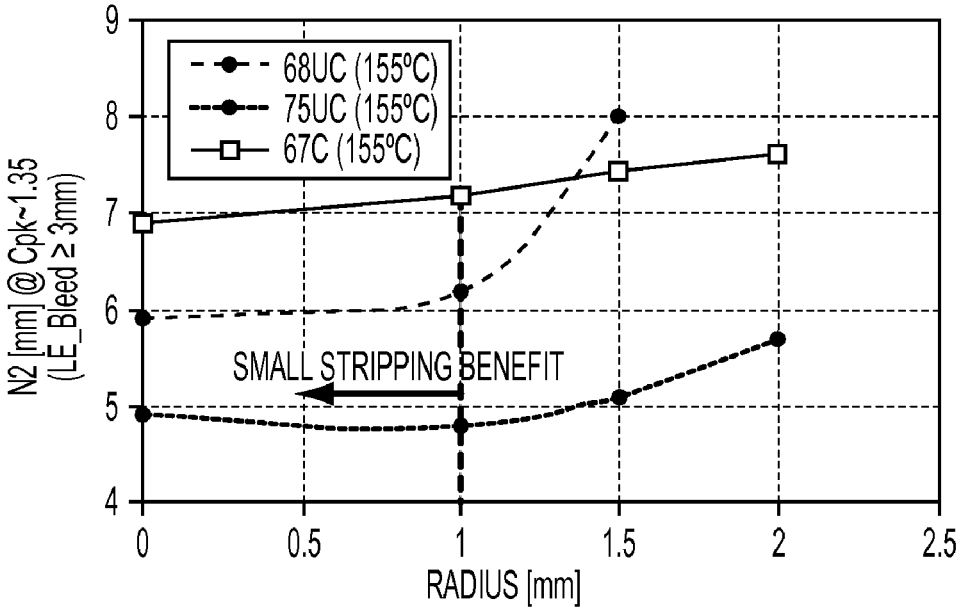
FIG. 6 illustrates the length of the second nip $N_2$ as a function of the stripping radius R of the stripping surface for 68 gsm uncoated paper (68UC), 75 gsm uncoated paper (75UC) and 67 gsm coated paper (67C) without an air knife.

It has been determined that the fixing device 300 depicted in FIG. 3, which does not include an air knife, can strip media with a small stripping radius R of the stripping surface 363 and a large (i.e., long) second nip $N_2$. FIG. 6 illustrates the length of the second nip $N_2$ (measured from $OE_1$ to $OE_2$ along the outer surface 342 of the pressure roll 340) as a function of the stripping radius R of the stripping surface for 68 gsm uncoated paper (68UC), 75 gsm uncoated paper (75UC) and 67 gsm coated paper (67C). Typical temperatures used for fixing toners on these papers are indicated for the given combination of productivity, fixing device speed and first nip $N_1$, which provide a dwell time of about 30 to about 35 ms.

As indicated in FIG. 6, a process capability index, $C_{pk}$, of 1.35 and a lead edge bleed ("LE_Bleed") of ≧3 mm are used. The process capability index $C_{pk}$ takes account of off-centeredness and is effectively the $C_p$ value for a centered process producing a similar level of defects, where a defect is considered in cases where a medium with a lead edge bleed of ≧3 mm fails to strip. A $C_{pk}$ value of at least about 1.33 is considered acceptable in embodiments of the fixing devices. The lead edge bleed of a medium is the distance from the lead edge of the medium to the beginning (lead edge) of an image formed on the medium.

The results shown in FIG. 6 demonstrate that using a stripping radius R smaller than 1 mm provides only a small benefit in regard to stripping performance. Moreover, decreasing the stripping radius R increases wear of the inner surface of the fixing belt.

It has been noted that for paper weights of about 60 gsm to about 80 gsm, as represented in FIG. 6, when the length of the second nip $N_2$ comes close to about 8 mm with the stripping edge 362 of the stripping device 360 at a distance of about 8 mm from the outlet end $OE_1$, an "icicle" image gloss defect may form on the paper. These defects, which grow inwardly from the lead edge of images formed on paper, are caused by early differential stripping of media from the fixing belt. These defects are more prevalent when heavy-weight media are run in apparatuses with a large second nip $N_2$ length. When a large second nip $N_2$ length is used, heavy-weight media can strip from the belt before they reach the location of the belt overlying the stripping surface, resulting in the formation of icicle defects on the media.

FIG. 7 shows the process capability index $C_{pk}$ as a function of second nip $N_2$ length and stripping angle ($\alpha$) for 68 gsm uncoated paper (68UC), 75 gsm uncoated paper (75UC), 67 gsm coated paper (67C), 90 gsm coated paper (90C) and 120 gsm coated paper (120C) for a stripping radius R of 1 mm and a distance from the stripping edge to $OE_1$ of about 8 mm for a fixing device without an air knife and a lead edge bleed of $\geqq 3$.

TABLE 1 shows values of the process capability index $C_{pk}$ and DPM (defects per million opportunities) for one-sided specification limit of $C_{pk}$.

TABLE 1

| Cpk | DPM |
|---|---|
| 0 | 500,000 |
| 0.167 | 308,538 |
| 0.33 | 158,655 |
| 0.50 | 66,807 |
| 0.667 | 22,750 |
| 0.833 | 6,210 |
| 1.000 | 1,350 |
| 1.167 | 233 |
| 1.33 | 32 |
| 1.50 | 3 |

As shown in FIG. 7, the process capability index $C_{pk}$ increases as $N_2$ increases for each media type. A smaller second nip $N_2$ length achieves a process capability index value $C_{pk}$ of at least 1.35 for heavier media.

The pressure profiles of the nip 344 of the fixing device 300 shown in FIG. 3 and of the nip 444 of the nip 444 of the fixing device 400 shown in FIG. 4 each include regions having two different pressure limits. The first pressure limit is a water vapor pressure limit. The second pressure limit is a gas bubbles pressure limit.

Regarding the water vapor pressure limit, when toner is used as the marking material to form images on media, during the time period that the toner is not well adhered to the media located at the first nip $N_1$, liquid contained in the media may be able to escape through the toner in the state of water vapor. This situation can occur when liquid contained in the media changes to vapor when the nip pressure is lower than the saturated pressure for water at the given temperature. The escape of water vapor can result in damage to the toner image.

FIG. 8 shows a phase diagram of water illustrating which states exist at different temperatures and pressures. A typical temperature applied at the fixing belt/toner interface to fix toner onto paper is about 120° C. The saturated pressure of water at this temperature is about 45 psi. Accordingly, to avoid the formation of water vapor during fixing of toner at this temperature, it is desirable to maintain the pressure at the first nip $N_1$ above about 45 psi. At different toner fixing temperatures, the pressure at the first nip $N_1$ can be maintained above the saturated pressure for water at those temperatures to avoid water vapor formation. For example, FIG. 8 shows that the nip pressure can be lower than 45 psi at fixing belt/toner interface temperatures lower than 120° C. to avoid the formation of water vapor.

Regarding the gas bubbles pressure limit, air bubbles inside the marking material, e.g., toner, can escape from the toner when it is hot at very low pressures, especially when the toner is not well fixed to media. The gas bubbles pressure limit can be defined as the minimum pressure, p, sufficient to contain air bubbles within a marking material layer. The minimum pressure p at a temperature, T, is given by: $p=p_0((273-T)/(T_0-1))$, where $p_0$ is the ambient pressure and $T_0$ is the ambient temperature. The pressure limit for air bubbles is typically about 5 psi for a fixing belt/toner interface temperature of about 120° C.

In light of these and other considerations, embodiments of the apparatuses useful in printing include a nip configuration that can strip different types of media from the fixing belt while applying a low load to the inner surface of the fixing belt at the second nip $N_2$. The apparatuses can strip the different types of media from the fixing belt while avoiding icicle defect formation on the media. Embodiments of the apparatuses can provide improved image quality, as well as extended belt life.

The nip configurations of the fixing devices allow a pressure profile as depicted in FIG. 9 to be achieved for stripping media from the fixing belt. For example, the illustrated pressure profile shown can be produced in the nip 344 of the fixing device 300 shown in FIG. 3 (in which the position of the stripping device 360 can be adjustably positioned) and in the nip 444 of the fixing device 400 shown in FIG. 4 (in which the stripping device 460 has a fixed position). The pressure profile shown in FIG. 9 meets both the water vapor minimum pressure limit within the first nip $N_1$, and the air bubble minimum pressure limit for both the first nip $N_1$ and second nip $N_2$. FIG. 9 shows the nip pressure as a function of the process direction distance for second nip $N_2$ lengths of 2 mm and 7 mm. A nip pressure of at least 45 psi is produced along the process direction in the region from about 19 mm to about 35 mm, which encompasses the first nip $N_1$. A nip pressure of at least 5 psi is produced in the region from about 36 mm to about 39 mm, which encompasses the second nip $N_2$ length of 2 mm, and also in the region from about 36 mm to about 43 mm, which encompasses the second nip $N_2$ with a length of 7 mm.

In the fixing devices 300, 400, the first nip $N_1$ is sufficiently large to allow marking material to be fixed onto media occurs substantially at the first nip $N_1$. In the fixing devices 300, 400, it is sufficient that the second nip $N_2$ apply a low pressure to media because the second nip $N_2$ is configured to strip media from the fixing belts 302, 402, respectively, not for fixing marking materials onto the media. In the fixing devices 300, 400, media can be stripped without subjecting the fixing belts 302, 402, respectively, to high pressure loads. Consequently, the fixing devices 300, 400 can reduce internal wear of the fixing belt 302, 402.

FIG. 10 illustrates the length of second nip $N_2$ as a function of media weight for a stripping edge to outlet end $OE_1$ distance of about 8 mm. FIG. 10 shows temperature set points for the fixing devices 300, 400, for media within the weight ranges of 60 gsm to 80 gsm, >80 gsm to 140 gsm, and >140 gsm (heavy-weight media). For a given media weight between 60 gsm and 320 gsm, by keeping the length of second nip $N_2$ below the curve shown in FIG. 10, the formation of icicle defects on the media can be completely avoided. As shown, as the media weight increases, the maximum second nip $N_2$ length that avoids icicle defect formation decreases. To strip light-weight media having a weight of 60 gsm to 140 gsm without producing icicle defects, a large second nip $N_2$ length of less than about 8 mm at 60 gsm to less than about 7.5 mm at 140 gsm is desirable. To strip heavy-weight media without icicle defect formation, a smaller second nip $N_2$ length of less than about 7.5 mm at 140 gsm to less than about 2 mm at 320 gsm is desirable.

For heavy-weight media, a short second nip $N_2$ length is effective to both avoid icicle defect formation (FIG. 10) and strip such media from fixing belts.

For light-weight media, FIG. 7 and FIG. 10 show that the length of second nip $N_2$ should be sufficiently short to avoid icicle defects, but sufficiently long to allow stripping of these media from fixing belts. It has been determined that these two competing factors can both be satisfied for light-weight media with respect to the length of second nip $N_2$, by using either of the fixing devices 300, 400 as depicted in FIGS. 3 and 4. In the fixing device 300, the movable stripping device 360 provides the capability to form a large second nip $N_2$ length sufficient for stripping light-weight media (<140 gsm), or a small second nip $N_2$ length sufficient for stripping heavy-weight media (>140 gsm). For example, the stripping device 360 is movable to form a second nip $N_2$ length of about 7 mm for stripping light-weight media and a shorter second nip $N_2$ length of about 2 mm for heavy-weight media. This adjustability of the stripping device 360 allows stripping of media with no marking material on the lead edge for about the first 3 mm for the full range of the process capability index $C_{pk}$ without icicle defect formation for any media weight used in the fixing device 300.

FIG. 11 shows the second nip $N_2$ length as a function of air knife inlet pressure for a fixing device including a stripping device and an air knife (e.g., the fixing device 400 depicted in FIG. 4 with the stripping edge 462 about 8 mm from outlet end $OE_1$ for 67 gsm coated paper (67C) at a stripping radius of 1 mm, 68 gsm uncoated paper (68UC) at a stripping radius of 1 mm, and 67 gsm coated paper (67C) at a stripping radius of 2 mm. FIG. 11 shows that no icicle defects occur at a second nip $N_2$ length of less that 8 mm. For the 67 gsm coated paper at a stripping radius of 1 mm and the 68 gsm uncoated paper, the air knife can be turned OFF without icicle defect formation. For the 67 gsm coated paper at a stripping radius of 2 mm and lower stripping force, an air inlet pressure of at least about 5 psi is sufficient to avoid icicle defect formation.

In an exemplary embodiment of the fixing device 300, for a fixing roll 308 diameter of about 100 mm, the following settings can be used to avoid icicle defects for different media weights: second nip $N_2$ length of about 2 mm to about 7 mm; fixing belt 302 stripping angle $\alpha$ of about 20° to at least about 30°; stripping radius R of the stripping device 360 of about 1 mm to about 5 mm; and distance from the stripping edge 362 to the outlet end $OE_1$ of the first nip $N_1$ of about 6 mm to about 10 mm. As the diameter of the fixing roll 308 is increased above 100 mm to increase productivity, the lengths of the first nip $N_1$ and second nip $N_2$, and the distance from the stripping edge 362 to the outlet end $OE_1$ of the first nip $N_1$ can be increased proportionally.

In an exemplary embodiment of the fixing device 400, for a fixing roll 308 diameter of about 100 mm, the following settings can be used to avoid icicle defects for different media weights: second nip $N_2$ length of about 2 mm to about 7 mm; fixing belt 402 stripping angle $\alpha$ of about 20° to at least about 30°; stripping radius R of the stripping device 460 of about 1 mm to about 10 mm; and distance from the stripping edge 462 to the outlet end $OE_1$ of the first nip $N_1$ of about 6 mm to about 10 mm. As the diameter of the fixing roll 408 is increased above 100 mm to increase productivity, the lengths of the first nip $N_1$ and second nip $N_2$, and the distance from the stripping edge 462 to the outlet end $OE_1$ of the first nip $N_1$ can be increased proportionally.

Although the above description is directed toward fixing device apparatuses used in xerographic printing, it will be understood that the teachings and claims herein can be applied to any treatment of marking material on media. For example, the marking material can be comprised of toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a first member including a first outer surface;

a second member including a second outer surface;

a fixing belt including an inner surface and a third outer surface;

a first nip formed by contact between the inner surface of the fixing belt and the second outer surface and contact between the third outer surface of the fixing belt and the first outer surface, the first nip including a first inlet end and a first outlet end at which the fixing belt separates from the second outer surface;

a second nip formed by contact between the third outer surface of the fixing belt and the first outer surface, the second nip extending from the first outlet end to a second outlet end at which the fixing belt separates from the first outer surface, the second nip having a length of less than about 8 mm between the first outlet end and the second outlet end; and a stripping device including a curved stripping edge contacting the inner surface of the fixing belt, the stripping edge being defined by a radius of less than about 10 mm, the stripping edge being spaced from the first outlet end of the first nip by a distance of less than about 10 mm, and the fixing belt bending at a stripping angle of about 20° to about 30° at the stripping edge, the stripping device being adjustably movable by a mechanism to vary the distance from the stripping edge to the first outlet end of the first nip;

wherein media are stripped from the third outer surface after exiting from the first outlet end of the first nip.

2. The apparatus of claim 1, wherein:

the second nip has a length of about 2 mm to about 7 mm between the first outlet end and the second outlet end; and the stripping edge is defined by a radius of about 1 mm to about 2 mm.

3. The apparatus of claim 1, wherein the stripping edge of the stripping device is spaced from the first outlet end of the first nip by a distance of less than about 8 mm.

4. The apparatus of claim 1, further comprising an air knife disposed downstream from the stripping edge of the stripping device, the air knife including a plurality of nozzles oriented to eject gas toward the third outer surface of the fixing belt to facilitate stripping of the media from the third outer surface.

5. The apparatus of claim 4, wherein the air knife is configured and positioned such that the media do not contact the air knife after exiting the second outlet end of the second nip when the nozzle gas ejection is either ON or OFF.

6. The apparatus of claim 4, wherein the stripping device has a fixed position.

7. The apparatus of claim 1, further comprising at least one heating element for heating the fixing belt.

8. The apparatus of claim 1, wherein:

the first nip has a length of about 15 mm to about 22 between the first inlet end and the first outlet end;

the first nip has a pressure of about 45 psi to about 120 psi; and the second nip has a pressure of at least about 6 psi.

9. An apparatus useful in printing, comprising:

a first roll including a first outer surface;

a second roll including a second outer surface;

a heated fixing belt including an inner surface and a third outer surface;

a first nip formed by contact between the inner surface of the fixing belt and the second outer surface and contact between the third outer surface of the fixing belt and the first outer surface, the first nip including a first inlet end and a first outlet end at which the fixing belt separates from the second outer surface;

a second nip formed by contact between the third outer surface of the fixing belt and the first outer surface, the second nip extending from the first outlet end to a second outlet end at which the fixing belt separates from the first outer surface, the second nip having a length of less than about 8 mm between the first outlet end and the second outlet end; and a stripping device including a curved stripping edge contacting the inner surface of the fixing belt, the stripping edge being defined by a radius of less than about 10 mm, the stripping edge being spaced from the first outlet end of the first nip by a distance of less than about 8 mm, and the fixing belt bending at a stripping angle of about 20° to about 30° at the stripping edge, the stripping device being adjustably movable by a mechanism to vary the distance from the stripping edge to the first outlet end of the first nip;

wherein media are stripped from the third outer surface after exiting from the first outlet end of the first nip.

10. The apparatus of claim 9, wherein:

the second nip has a length of about 2 mm to about 7 mm between the first outlet end and the second outlet end; and the stripping edge is defined by a radius of about 1 mm to about 2 mm.

11. The apparatus of claim 9, further comprising an air knife disposed downstream from the stripping edge of the stripping device at a fixed position, the air knife including a plurality of nozzles oriented to eject gas toward the third outer surface of the fixing belt to facilitate stripping of the media from the third outer surface, the air knife being configured and positioned such that the media do not contact the air knife after exiting the second outlet end of the second nip when the nozzle gas ejection is either ON or OFF.

12. The apparatus of claim 9, wherein:

the second roll has a diameter of about 75 mm to about 100 mm; and the first nip has a length of about 15 mm to about 22 mm between the first inlet end and first outlet end.

13. The apparatus of claim 9, wherein:

the first nip has a pressure of about 45 psi to about 120 psi; and the second nip has a pressure of at least about 6 psi.

14. A method of stripping media from a surface in an apparatus useful in printing, the apparatus comprising a first roll including a first outer surface, a second roll including a second outer surface, a heated fixing belt including an inner surface and a third outer surface, a first nip formed by contact between the inner surface of the fixing belt and the second outer surface and contact between the third outer surface of the fixing belt and the first outer surface, the first nip including a first inlet end and a first outlet end at which the fixing belt separates from the second outer surface, a second nip formed by contact between the third outer surface of the fixing belt and the first outer surface, the second nip extending from the first inlet end to a second outlet end at which the fixing belt separates from the first outer surface, and a stripping device disposed internal to the fixing belt, the stripping device including a curved stripping edge contacting the inner surface of the fixing belt, the stripping edge being defined by a radius of less than about 10 mm, the method comprising:

positioning the stripping device to set a length of the second nip between the first outlet end and the second outlet end to less than about 8 mm and a distance from the stripping edge to the first outlet end to less than about 8 mm, the fixing belt bending at a stripping angle of about 20° to about 30° at the stripping edge, the stripping device being adjustably movable by a mechanism to vary the distance from the stripping edge to the first outlet end of the first nip;

contacting a medium carrying a marking material with the third outer surface of the belt at the first nip; and stripping the medium from the third outer surface of the belt downstream from the first nip with the stripping device.

15. The method of claim 14, wherein:

the length of the second nip is about 2 mm to about 7 mm; and the stripping edge is defined by a radius of about 1 mm to about 2 mm.

16. The method of claim 14, further comprising ejecting gas toward the third outer surface of the fixing belt with an air knife disposed downstream from the stripping edge of the stripping device to facilitate stripping of the medium from the third outer surface.

17. The method of claim 14, wherein:

the first nip has a length of about 15 mm to about 22 mm between the first inlet end and first outlet end;

the first nip has a pressure of about 45 psi to about 120 psi; and the second nip has a pressure of at least about 6 psi.

* * * * *